US005549488A

United States Patent [19]

Berndt et al.

[11] Patent Number: 5,549,488

[45] Date of Patent: Aug. 27, 1996

[54] ELECTRICAL ASSEMBLY WITH MULTIPLE ARRANGEMENT

[75] Inventors: Curtis G. Berndt, Fremont, Ind.; Daniel R. Van Dyk, Belding, Mich.; David A. Van Dyk, Grand Rapids, Mich.; Steven C. Deer, Kentwood, Mich.; Royal A. Kent, Grand Rapids, Mich.

[73] Assignee: Pent Products, Inc., Kendallville, Ind.

[21] Appl. No.: 285,184

[22] Filed: Aug. 3, 1994

[51] Int. Cl.[6] ..... H01R 13/64

[52] U.S. Cl. ..... 439/680; 439/215; 439/701

[58] Field of Search ..... 439/121, 207, 439/209, 211, 215, 678, 680, 681, 698, 701, 502, 505, 610, 350, 357

[56] References Cited

U.S. PATENT DOCUMENTS

| | | | |
|---|---|---|---|
| 3,456,231 | 7/1969 | Paullus et al. . | |
| 3,547,274 | 12/1970 | Sosinski . | |
| 4,135,775 | 1/1979 | Driscoll . | |
| 4,306,374 | 12/1981 | Wharrie . | |
| 4,688,869 | 8/1987 | Kelly . | |
| 5,152,698 | 10/1992 | Juhlin et al. | 439/215 |
| 5,236,370 | 8/1993 | King et al. | 439/215 |
| 5,370,556 | 12/1994 | Olsson | 439/680 X |

FOREIGN PATENT DOCUMENTS

| | | |
|---|---|---|
| 354582 | 8/1989 | European Pat. Off. . |
| 779946 | 7/1957 | United Kingdom . |

*Primary Examiner*—Khiem Nguyen
*Attorney, Agent, or Firm*—Barnes & Thornburg

[57] ABSTRACT

A re-wired electrical assembly with multiple keying arrangement has channel-shaped raceways which receive plug receptacles. Electrical contacts are disposed in each of the plug receptacles and are selectively oriented in one of a plurality of predetermined positions. Jumper cable assemblies including two plugs electrically coupled by an intermediate cable are used to join a pair of channels having plug receptacles therein. Terminals are disposed in each of the plugs and are selectively oriented so as to mate with corresponding contacts in the plug receptacles. The keying arrangement prevents improper connection between the plugs and plug receptacles. Specifically, the keying arrangement includes guide members molded on the interior surface of bores surrounding each contact in the plug receptacles. Slotted sleeves enclose the terminals, and a slot mates with at least one of the guide members in the plug receptacle. In this manner, a particular terminal will only mate with a contact oriented in the same direction.

34 Claims, 5 Drawing Sheets

ELECTRICAL ASSEMBLY WITH MULTIPLE ARRANGEMENT

BACKGROUND AND SUMMARY OF THE INVENTION

The present invention relates to pre-wired electrical systems which may be used to transmit power, data or communications from one point to another along a series of modular wall panels, and, more particularly, to a keyed, pre-wired electrical system for preventing circuits from becoming inadvertently crossed.

Various systems for transmitting power, data and communications in an office are known in the prior art. In particular, systems for transmitting power and information along a series of modular wall panels are known. In such systems, electrical conductors are generally disposed in a housing or covering and are strung beneath the panels. Such structures protect the conductors from damage and keep them out of sight.

Additionally, multiple conductors are often disposed within the same housing or protective covering. It may be that the separate conductors form separate circuits and are electrically coupled to different pieces of equipment. If so, this separation of conductors likely needs to be maintained throughout the pre-wired system. Thus, it may be desirable to provide a pre-wired structure which includes means for preventing incompatible conductors from being electrically coupled along the path of the system.

Furthermore, the modular wall panels forming the various office cubicles are often rearranged to create different floor plans. When the wall panels are reconfigured, the electrical system must be moved accordingly. Thus, it may be desirable to utilize a pre-wired electrical system which may be easily disconnected, reconfigured and reconnected. It may be further advantageous if reconfiguration could be performed by relatively unskilled workers.

Thus, it is an object of the present invention to provide an improved pre-wired electrical system.

Another object of the present invention is to provide a pre-wired electrical system that is relatively easy to install and reconfigure.

Yet another object of the present invention is the provision of a pre-wired electrical system that includes means for preventing individual circuits from becoming inadvertently crossed.

These and other objects of the present invention are attained by the provision of first and second plug receptacles in a pair of raceways in bases for modular wall panels. At least one electrical contact is disposed in each of the plug receptacles and is selectively oriented in one of a plurality of predetermined, fixed orientations. First and second plugs including housings having terminals disposed therein are utilized. The terminals are surrounded by sleeves. The terminals are electrically coupled and selectively oriented so as to mate with a corresponding electrical contact in the two plugs.

In another embodiment of the present invention, the plug receptacles and plugs are provided with keying means for preventing circuits from becoming inadvertently crossed. Specifically, the keying means includes a bore having at least one guide member extending therefrom surrounding each of the electrical contacts. The terminal sleeves have at least one slot therein for engaging one of the guide members.

In another embodiment of the present invention, two plug receptacles are inserted in each raceway and a second set of plugs are provided for coupling with the additional plug receptacles.

In another embodiment of the present invention, the plugs include means for attaching flexible tongues thereto. The tongues engage ridges formed on the plug receptacles and assist in securing the plugs to the plug receptacles.

In another embodiment of the present invention, the raceways are generally U-shaped channels and include covers for engaging the open side of the channel. Projections are formed in the top, bottom and sides of the channel and engage slots on the plug receptacles to secure them in the channels.

Other objects, advantages and novel features of the present invention will become apparent when considering the following detailed description of the preferred embodiments in conjunction with the accompanying drawings.

DETAILED DESCRIPTION OF THE PREFERRED EMBODIMENTS

Figure 1:
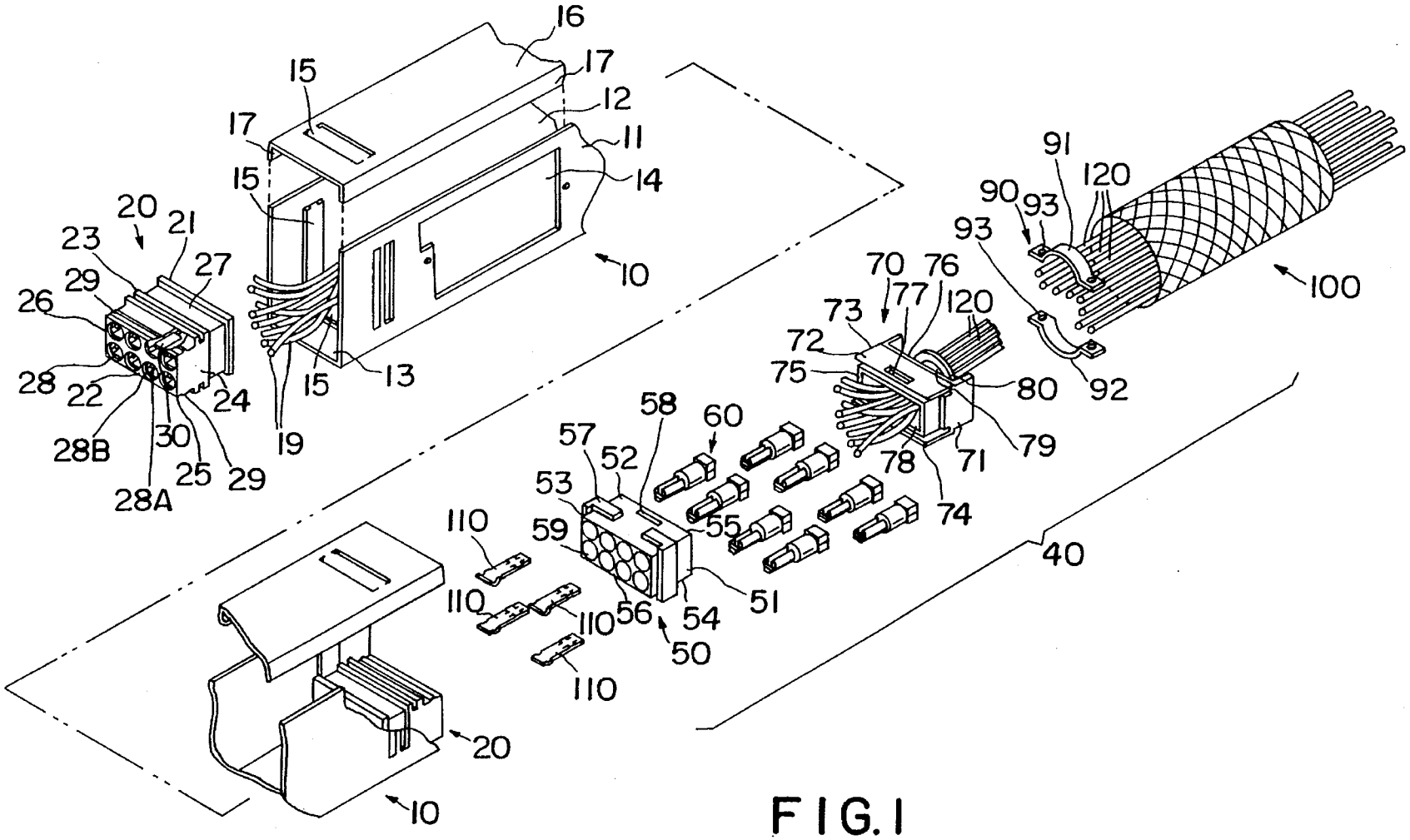
FIG. 1 is an exploded perspective view of a pre-wired electrical assembly according to the present invention.

FIG. 1 shows an exploded perspective view of an embodiment of a pre-wired electrical assembly according to the present invention. The assembly generally comprises channel-shaped raceway 10, plug receptacle 20 and jumper cable assembly 40. Jumper cable assembly 40 further generally comprises plug 50, terminal assemblies 60, strain relief 70, bracket 90, cable sleeve 100, and flexible tongues 110.

Raceway 10 includes front wall 11, rear wall 12, bottom 13 and cover 16. Cover 16 includes two downwardly projecting sides 17, which engage front wall 11 and rear wall 12. Front wall 11 further includes port 14 cut therein. Port 14 may be configured so as to accommodate various outlet or power supply assemblies, as are known in the art. Raised projections 15 are formed on front wall 11, rear wall 12, bottom 13 and cover 16. Projections 15 interact with plug receptacle 20 to secure plug receptacle 20 in raceway 10 as described below. A plurality of electrical conductors 19 are disposed in raceway 10.

Plug receptacle 20 includes back side 21, face 22, top 23, left side 24, bottom 25 and right side 26. Peripheral groove 27 is formed in plug receptacle 20 and interacts with tongues 15 in raceway 10 to secure plug receptacle 20 in raceway 10, as described below. A plurality of bores 28 extend through face 22 of plug receptacle 20. Top side 23 and bottom side 25 of plug receptacle 20 are provided with ridges 29, the function of which is described below.

Figure 1A:
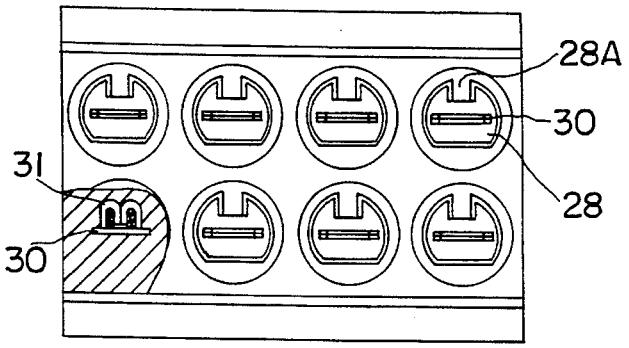
FIG. 1A is a partial cut-away, front plan view of a plug receptacle for a pre-wired electrical assembly according to the present invention.

An electrical contact 30 is disposed within each bore 28. Contact 30 includes wire mount 31 (FIG. 1A) to which a conductor 19 may be electrically coupled. Each bore 28 includes a guide 28A, which is utilized to guide terminal assemblies 60 into the proper position in bores 28, as described below.

Plug receptacles 20 are molded plastic components. Thus, to form a plug receptacle 20 with contacts 30 disposed therein, contacts 30 having conductors 19 attached thereto via wire mounts 31 are first placed in a mold. The mold is then injected with a plastic material to form plug receptacle 20, including bores 28, guides 28A, and ridges 29.

Plug 50 includes left side 51, top 52, right side 53, bottom 54, back side 55 and face 56. A pair of slotted tabs 57 is formed on top 52 and bottom 54 of plug 50. Slotted tabs 57 accommodate flexible tongues 110, which assist in securing jumper cable assembly 40 to plug receptacle 20, as described below. Plug 50 further includes a ledge 58 formed on each of top 52 and bottom 54. Ledges 58 engage strain relief 70, as described below. Bores 59 are cut in plug 50 to accommodate terminal assemblies 60.

Figure 2:
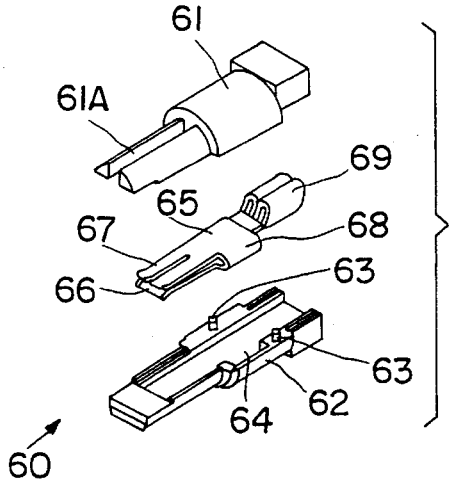
FIG. 2 is an exploded perspective view of a terminal assembly for a pre-wired electrical system according to the present invention.

FIG. 2 shows an exploded view of a terminal assembly 60. Each terminal assembly 60 includes a sleeve comprised of top section 61 and bottom section 62. Slot 61A is provided in top section 61. Slot 61A interacts with top guide 28A as described below. Two pegs 63 are disposed on bottom section 62 and mate with corresponding holes (not shown) in top section 61. Bottom section 62 and top section 61 further include recessed area 64 therein. A female terminal 65 is positioned between and encased by top section 61 and bottom section 62. Female terminal 65 includes bottom member 66 and top member 67 joined by bight 68. Female terminal 65 is formed such that bottom member 66 and top member 67 are biased toward each other so as to be able to snugly engage a contact 30, as described below. Female terminal 65 further includes wire mount 69 to which an electrical conductor (not shown) is secured. Bight 68 of female terminal 65 rests in recessed areas 64 on top section 61 and bottom section 62.

Returning to FIG. 1, strain relief 70 includes left side 71, top tongue 72, right side 73, bottom tongue 74, face 75 and rear 76. Each of top tongue 72 and bottom tongue 74 have a slot 77 cut therein. Slots 77 engage ledges 58 on plugs 50, as described below. Strain relief 70 further includes a tubular member 79 extending from rear 76 thereof. Tubular member 79 terminates in flange 80. Tubular member 79 and flange 80 are used to secure cable sleeve 100 to strain relief 70, as described below.

Attachment bracket 90 includes top half 91 and bottom half 92. Each half of bracket 90 includes mounting holes 93 therein.

Cable sleeve 100 comprises a generally tubular member made from a durable, pliable material such as woven fiberglass. Alternatively, flexible or semirigid electrical conduit may be used. A plurality of electrical conductors 120 are disposed in cable sleeve 100.

Figure 3:
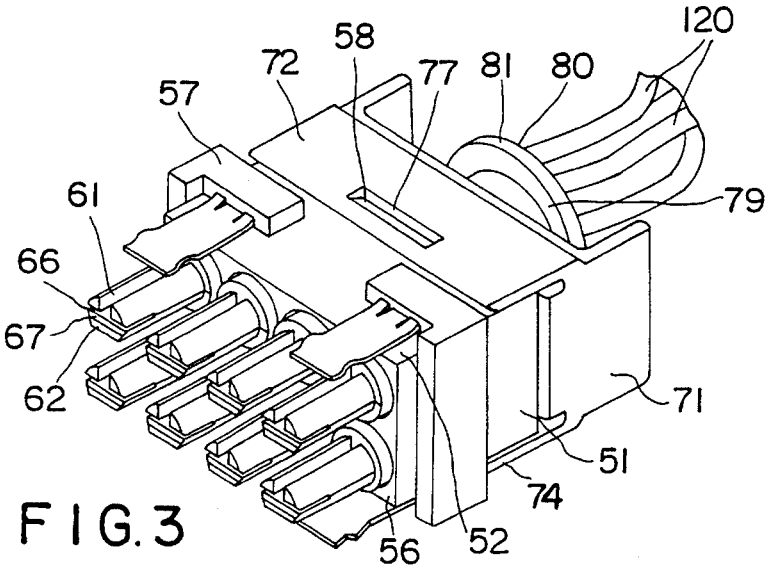
FIG. 3 is a perspective view of a fully assembled plug for a pre-wired electrical system according to the present invention.

Turning to FIG. 3, each terminal assembly 60 is electrically coupled to a conductor 120 by feeding conductors 120 through tubular member 79 of strain relief 70, out face 75, and attaching them to wire mounts 69. Terminal assemblies 60 are then inserted through rear side 55 of plug 50 such that terminal assemblies 60 extend through bores 59. Strain relief 70 is then mated with plug 50 by sliding face 75 of strain relief 70 into rear side 55 of plug 50. As strain relief 70 is slid into contact with plug 50, top tongue 72 and bottom tongue 74 flex upwardly and downwardly, respectively, as each slides over a ridge 58. When an opening 77 is directly over a ridge 58, top tongue 72 snaps downwardly and bottom tongue 74 snaps upwardly, thereby engaging slot 77 and ridge 58. Thus, strain relief 70 and plug 50 are securely joined.

Figure 4:
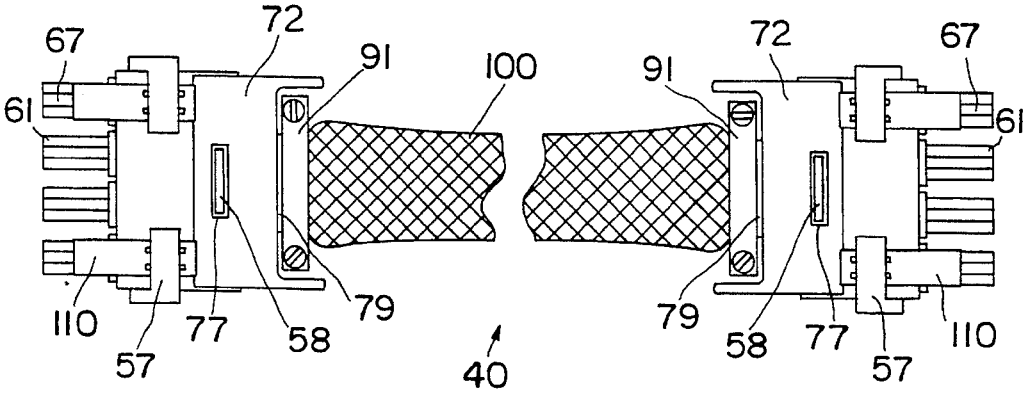
FIG. 4 is a top plan view of a jumper cable assembly for a pre-wired electrical assembly according to the present invention.
Figure 5:
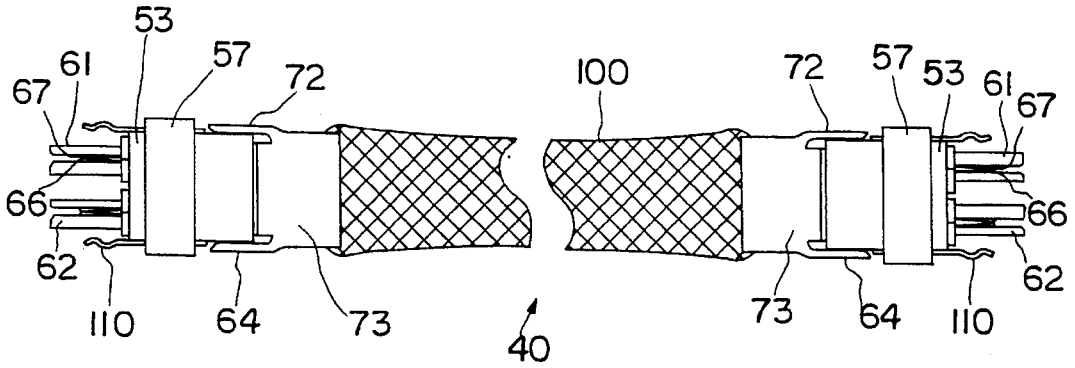
FIG. 5 is a side plan view of a jumper cable assembly for a pre-wired electrical assembly according to the present invention.

Cable sleeve 100 may then be attached to strain relief 70 by positioning cable sleeve 100 about tubular member 79 and flange 80 and securing bracket 90 about tubular member 79, over cable sleeve 100. Bracket 90 may be secured by inserting screws or similar fasteners through holes 93. Thus, cable sleeve 100 is clamped securely to strain relief 70. FIGS. 4 and 5 show top plan and side plan views, respectively, of a fully assembled jumper cable assembly 40 with a plug 50 and strain relief 70 mounted on each end thereof.

Figure 6:
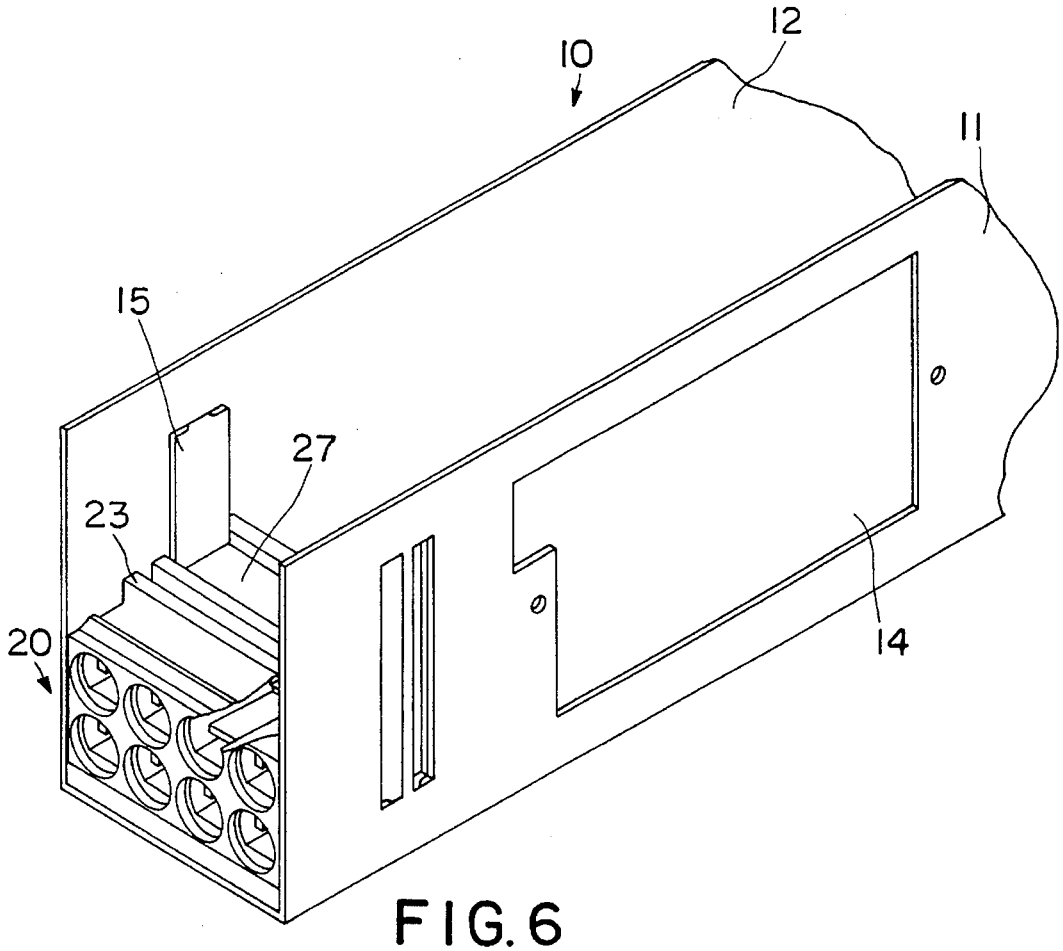
FIG. 6 is a perspective view of a plug receptacle disposed within a raceway.

FIG. 6 shows a partially assembled pre-wired electrical assembly according to the present invention. Specifically, a conductor 19 is electrically coupled to each contact 30, and plug receptacle 20 is shown mounted in raceway 10. To do so, plug receptacle 20 is positioned above the open side of raceway 10 and between front wall 11 and rear wall 12 such that peripheral groove 27 is aligned with projections 15. Plug receptacle 20 is then lowered into channel 10 such that projections 15 slide in groove 27. As can be seen in FIG. 6, raceway 10 and plug receptacle 20 are dimensioned such that a second plug receptacle 20 may be stacked on top of the first plug receptacle 20. If so, projections 15 on cover 16 will then rest in the top portion of peripheral groove 27 in the second plug receptacle 20.

Figure 7:
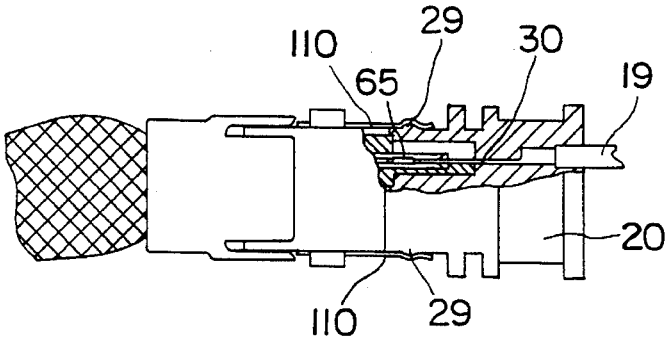
FIG. 7 is a partial cut-away, side plan view of a plug on one end of a jumper cable assembly engaged with a plug receptacle.

FIG. 7 shows the interaction of plug receptacle 20 and plug 50. As can be seen, terminal assemblies 60 are inserted in bores 28 of plug receptacle 20 such that contacts 30 are in electrical contact with lower portion 66 and upper portion 67 of female terminals 65 by being inserted therebetween. Additionally, top guide 28A in bore 28 engages slot 61A in top section 61 of terminal assembly 60 and assists in aligning assembly 60. Furthermore, flexible tongues 110 slide over ridges 29 on plug receptacle 20 and in doing so, press against and interlock with ridges 29. Thus, plug 50 and plug receptacle 20 are securely mated, and contacts 30 and female terminals 65 are electrically coupled.

As described above, when plug receptacle 20 is in place in raceway 10, conductors 19 running through raceway 10 are attached to contacts 30, thereby electrically coupling conductor 19 and contacts 30. Similarly, conductors 120 running through sleeve 100 are attached to corresponding wire mounts 69 of female terminals 65, thereby electrically coupling them. Thus, corresponding female terminals 65 in separate plugs 50 are electrically coupled. Accordingly, power may be supplied along a series of raceways 10 by joining them with a series of jumper cable assemblies 40. Power is conducted through conductors 19, to a contact 30, to a terminal 65, through conductors 120, to a corresponding terminal 65, to a corresponding contact 30 and through the next conductor 19. In this manner, the system may be used to supply power throughout an office, and in particular, may be utilized in a system of bases for modular wall panels.

Figure 8:
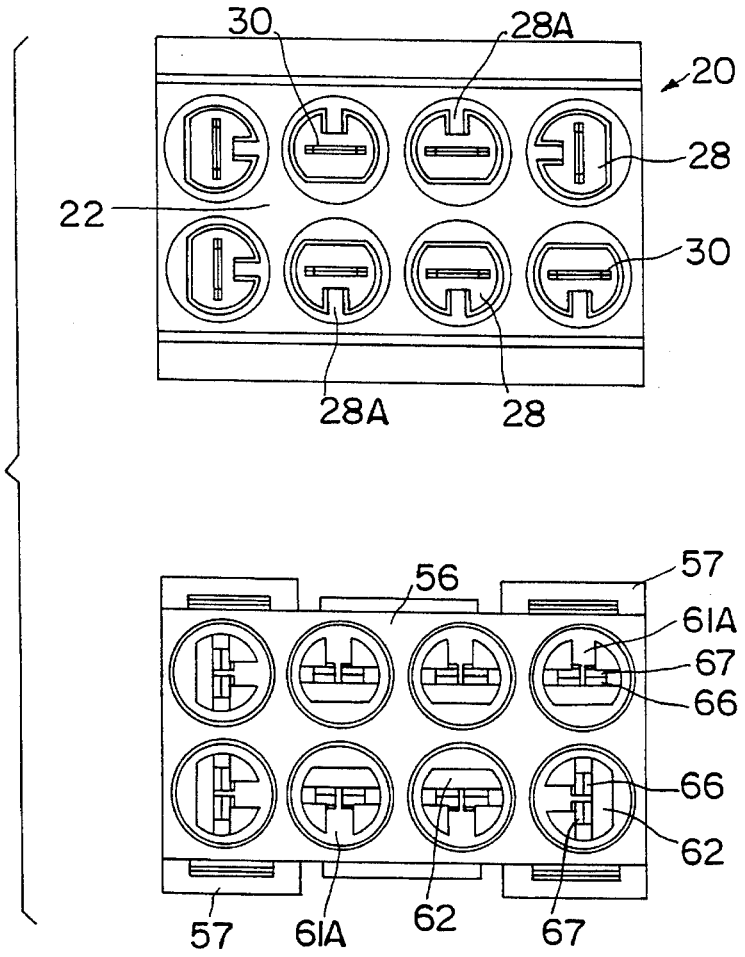
FIG. 8 is a front plan view of a plug and plug receptacle pair having a specifically keyed arrangement.

FIG. 8 illustrates an additional feature of the present invention. Specifically, in the above-described embodiment, all of the contacts 30, guides 28A, and terminal assemblies 60 were oriented in the same manner. However, as can be seen in FIG. 8, these components may be oriented in any one of four positions, if desired. Thus, as shown in FIG. 8, specific orientations of terminal assemblies 60, contacts 30 and guides 28A may be combined so as to produce a specific keyed arrangement. In this manner, terminal assemblies 60, contacts 30 and guides 28A may be oriented so as to prevent conductors in one raceway 10 from being inadvertently connected to the wrong conductor in a neighboring raceway 10. Specifically, a particular arrangement of contacts 30 and guides 28A would only mate with a corresponding configuration of terminal assemblies 60. Thus, during production of a pre-wired electrical assembly according to the present invention, various circuits may be designed with specific keyed arrangements such that after the assembly is shipped to the end user, it can only be assembled in one configuration. Such keyed arrangements provide several advantages. First, the system installers can always be certain that they are properly connecting the circuits because a jumper cable assembly for one circuit will not mate with a contact housing for another circuit. Also, such a keying arrangement reduces the likelihood of damage to circuitry and equipment through improper connection.

As discussed above, plug receptacles 20 are molded plastic members. In contrast, plugs 50 including terminal assemblies 60 are individually assembled from a plurality of components. Thus, after a plug receptacle 20 has been molded to include a particular arrangement of contacts 30, a plug 50 may be assembled to mate with the specific arrangement of contacts 30 in plug receptacle 20. In this manner, a set of common parts may be used to assemble plugs 50 to mate with various predetermined contact orientations in plug receptacles 20. Specifically, each plug 50 will only mate with a plug receptacle 20 that is specifically designed for that plug 50. It is intended that once a plug 50 is assembled to a particular configuration, it will not be disassembled, but rather, will be used only with the particular plug receptacle 20 for which it was constructed.

Figure 9:
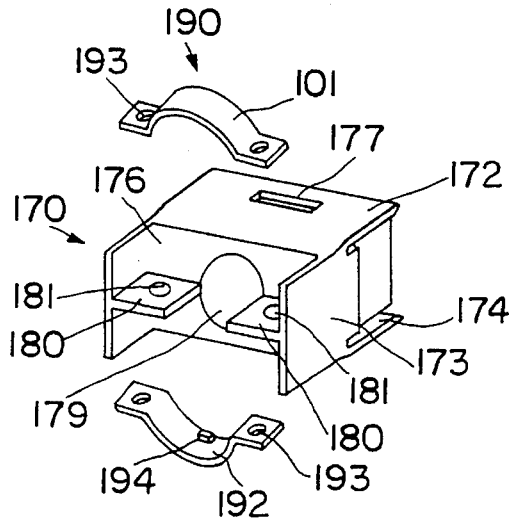
FIG. 9 is an exploded view of an alternative embodiment of a strain relief and bracket, which are components of the present invention.

Although the invention has been described and illustrated in detail, it is to be clearly understood that the same is by way of illustration and example only and is not to be taken by way of limitation. Variations may be made to the embodiment disclosed without departing from the scope of the invention. For example, FIG. 9 shows an alternative embodiment of strain relief 70 and bracket 90, in which the number "1" has been added before the remainder of the designation to indicate corresponding parts. In this embodiment, tubular member 79 has been replaced by a pair of tabs 180 extending from rear 176 about opening 179. Each tab 180 includes a hole 181. Bracket 190 includes teeth 194 disposed on the inner surface thereof. Strain relief 170 and bracket 190 may be used in conjunction with a cable sleeve 100 (not shown) of the flexible metal conduit variety. To secure such a cable sleeve 100 to strain relief 170, one end of cable sleeve 100 is placed adjacent opening 179. Bracket 190 is then secured to tabs 180 about sleeve 100 by inserting screws of similar fasteners through holes 193 and 181. When secured in this manner, teeth 194 engage grooves in cable sleeve 100 and hold it in place. Also, although the system has been described in conjunction with supplying power along a series of raceways, it may be used to transmit data, communications and other information as well. Accordingly, the spirit and scope of the invention are to be limited only by the terms of the appended claims.

What is claimed is:

1. An electrical arrangement for modular wall panels, comprising:

a first plug receptacle disposed in a raceway in a base of a first panel and a second plug receptacle disposed in a raceway in a base of a second panel;

at least one electrical contact disposed in each of said first and second plug receptacles, said contacts being disposed in a predetermined, fixed orientation;

first and second plugs, each of said plugs including at least one electrical terminal;

an insulating sleeve surrounding each of said terminals, said sleeves being separate from said first and second plugs, disposed inside of said first and second plugs, and selectively positionable in an orientation which allows said terminals to mate with said contacts; and electrically conducting cables connecting said terminals in said first plug to said terminals in said second plug.

2. The arrangement according to claim 1, wherein said first and second plug receptacles include means for engaging a portion of the first and second raceways, respectively.

3. The arrangement according to claim 2, wherein said means for engaging a portion of the raceways include slots formed around the peripheries of said plug receptacles, and wherein the raceways include projections which extend into said slots.

4. The arrangement according to claim 3, wherein said slots extend around at least three sides of said plug receptacles.

5. The arrangement according to claim 1, further comprising keying means for preventing a terminal from mating with an electrical contact that is not in the same orientation as said terminal.

6. The arrangement according to claim 5, wherein said keying means includes a bore surrounding each of said electrical contacts.

7. The arrangement according to claim 6, wherein said keying means further includes at least one guide member extending from an inner surface of said bore.

8. The arrangement according to claim 7, wherein said keying means further includes a slot in each of said sleeves for engaging said at least one guide member.

9. The arrangement according to claim 1, wherein said plugs include means for securing flexible tongues thereto and said plug receptacles include ridges that interact with said tongues to secure said plugs to said plug receptacles.

10. The arrangement according to claim 9, wherein said plugs include ledges and said cables have means attached thereto for engaging said ledges.

11. The arrangement according to claim 3, wherein said raceways comprise generally U-shaped channels and a cover for engaging an open side of said channel.

12. The arrangement according to claim 1, wherein said raceways include ports for receiving electrical receptacles.

13. The arrangement according to claim 11, wherein said projections are formed in the top, bottom and sides of said raceways.

14. The arrangement according to claim 1, wherein said plug receptacles are molded about said contacts.

15. The arrangement according to claim 1, further including:

a third plug receptacle adjacent said first plug receptacle and a fourth plug receptacle disposed adjacent said second plug receptacle;

at least one electrical contact disposed in each of said third and fourth plug receptacles, said contacts being disposed in a predetermined, fixed orientation;

third and fourth plugs, each of said plugs including at least one electrical terminal;

an insulating sleeve surrounding each of said terminals, said sleeves being separate from said third and fourth plugs, disposed inside of said third and fourth plugs, and selectively positionable in an orientation which allows said terminals to mate with said contacts; and electrically conducting cables connecting said terminals in said third plug to said terminals in said fourth plug.

16. A pre-wired electrical assembly, comprising:

a first channel and a second channel, each of said channels having at least one electrical conductor disposed therein;

a first plug receptacle disposed in said first channel and a second plug receptacle disposed in said second channel;

a first contact disposed in said first plug receptacle and electrically coupled to said electrical conductor in said first channel, said first contact being disposed in a predetermined, fixed orientation;

a second contact disposed in said second plug receptacle and electrically coupled to said electrical conductor in said second channel, said second contact being disposed in a predetermined fixed orientation;

a first plug having a first electrical terminal therein;

an insulating sleeve surrounding said first terminal, being disposed inside of said first plug, and oriented so as to electrically couple with said first contact;

a second plug having a second electrical terminal therein;

an insulating sleeve surrounding said second terminal, being disposed inside of said second plug, and oriented so as to electrically couple with said second contact; and means for electrically coupling said first and second terminals.

17. The assembly according to claim 16, wherein said first and second plug receptacles include means for engaging a portion of said first and second channels.

18. The assembly according to claim 17, wherein said means for engaging a portion of said channels includes a slot formed around the periphery of said plug receptacles and said channels include projections that engage said slots.

19. The assembly according to claim 18, wherein said slots extend around at least three sides of said plug receptacles.

20. The assembly according to claim 16, wherein said plugs include means for securing flexible tongues thereto and said plug receptacles include ridges that interact with said tongues to secure said plugs to said plug receptacles.

21. The assembly according to claim 16, wherein said plugs include ledges and said means for electrically coupling said terminals includes a cable having means for engaging said ledges.

22. The assembly according to claim 18, wherein said channels are generally U-shaped and further comprising a cover for engaging an open side of said channel.

23. The assembly according to claim 16, wherein said first and second channels each include a port for receiving an electrical receptacle.

24. The assembly according to claim 23, wherein said projections are formed in the top, bottom and sides of said first and second channels.

25. The arrangement according to claim 16, further including keying means for preventing a terminal from mating with an electrical contact that is not oriented in the same position as said terminal.

26. The arrangement according to claim 25, wherein said keying means includes a bore surrounding each of said electrical contacts.

27. The arrangement according to claim 26, wherein said keying means further includes at least one guide member extending from an inner surface of said bore.

28. The arrangement according to claim 27, wherein said keying means further includes a slot in each of said sleeves for engaging said at least one guide member.

29. The arrangement according to claim 16, wherein said first plug receptacle is molded about said first contact and said second plug receptacle is molded about said second contact.

30. The assembly according to claim 16, further including:

a third electrical conductor disposed in said first channel and a fourth electrical conductor disposed in said second channel;

a third plug receptacle adjacent said first plug receptacle and a fourth plug receptacle adjacent said second plug receptacle;

a third electrical contact disposed in said third plug receptacle and electrically coupled to said third electrical conductor, said third contact being disposed in a predetermined, fixed orientation;

a fourth electrical contact disposed in said fourth plug receptacle and electrically coupled to said fourth conductor, said fourth contact being disposed in a predetermined, fixed orientation;

a third plug having a third electrical terminal therein;

an insulating sleeve surrounding said third terminal, being disposed inside of said third plug, and oriented so as to electrically couple with said third contact;

a fourth plug having a fourth electrical terminal therein;

an insulating sleeve surrounding said fourth terminal, being disposed inside of said fourth plug, and oriented so as to electrically couple with said fourth contact; and means for electrically coupling said third and fourth terminals.

31. The arrangement according to claim 1, wherein the sleeves are selectively positionable in a plurality of angular positions about a fixed axis.

32. The arrangement according to claim 15, wherein the sleeves are selectively positionable in a plurality of angular positions about a fixed axis.

33. The assembly according to claim 16, wherein the sleeves are selectively positionable in a plurality of angular positions about a fixed axis.

34. The assembly according to claim 30, wherein the sleeves are selectively positionable in a plurality of angular positions about a fixed axis.

* * * * *

UNITED STATES PATENT AND TRADEMARK OFFICE

CERTIFICATE OF CORRECTION

PATENT NO. : 5,549,488

DATED : August 27, 1996

INVENTOR(S) : Curtis G. Berndt et al.

It is certified that error appears in the above-identified patent and that said Letters Patent is hereby corrected as shown below:

On title page, item [54], & Col. 1, line 2, to read "Electrical Assembly With Multiple Keying Arrangement".

Signed and Sealed this

Twelfth Day of November, 1996

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,549,488

DATED : August 27, 1996

INVENTOR(S) : Curtis G. Berndt, et al.

It is certified that error appears in the above-identified patent and that said Letters Patent is hereby corrected as shown below:

On title page, item [75], line 3, to read "David A. Van Dyke"

On title page, item [57], line 1, second word, to read "pre-wired"

Signed and Sealed this

Fifteenth Day of April, 1997

*Attest:*

BRUCE LEHMAN

*Attesting Officer*

*Commissioner of Patents and Trademarks*